US009533496B2

(12) United States Patent
Takeuchi et al.

(10) Patent No.: US 9,533,496 B2
(45) Date of Patent: Jan. 3, 2017

(54) APPARATUS FOR EJECTING LIQUIDS, EJECTION DETECTION APPARATUS, AND EJECTION DETECTOR

(71) Applicants: Shotaro Takeuchi, Kanagawa (JP); Shohei Saito, Kanagawa (JP); Takahiro Kikuchi, Kanagawa (JP)

(72) Inventors: Shotaro Takeuchi, Kanagawa (JP); Shohei Saito, Kanagawa (JP); Takahiro Kikuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/046,573

(22) Filed: Feb. 18, 2016

(65) Prior Publication Data

US 2016/0257113 A1 Sep. 8, 2016

(30) Foreign Application Priority Data

Mar. 2, 2015 (JP) ..... 2015-039894

(51) Int. Cl.
*B41J 2/045* (2006.01)

(52) U.S. Cl.
CPC ..... *B41J 2/04555* (2013.01); *B41J 2/04586* (2013.01)

(58) Field of Classification Search
CPC ..... B41J 2/0451; B41J 2/0455; B41J 2/04586; B41J 29/393; B41J 11/009; B41J 29/38; B41J 2/16579; B41J 2/165; B41J 2/2142; B41J 2/125; B41J 2/04541
See application file for complete search history.

(56) References Cited

U.S. PATENT DOCUMENTS

| | | | | |
|---|---|---|---|---|
| 7,645,007 | B2 * | 1/2010 | Komatsu | B41J 2/16579 347/14 |
| 8,919,921 | B2 | 12/2014 | Takeuchi | |
| 8,967,759 | B2 | 3/2015 | Masaoka et al. | |
| 9,028,039 | B2 | 5/2015 | Masaoka et al. | |
| 2010/0302295 | A1 * | 12/2010 | Watanabe | B41J 2/12 347/14 |
| 2015/0062223 | A1 | 3/2015 | Takeuchi et al. | |

FOREIGN PATENT DOCUMENTS

| | | |
|---|---|---|
| JP | 2014-097642 | 5/2014 |

* cited by examiner

*Primary Examiner* — Thinh H Nguyen
(74) *Attorney, Agent, or Firm* — Cooper & Dunham LLP

(57) ABSTRACT

An apparatus for ejecting liquids includes a liquid ejection head including a nozzle, the nozzle ejecting the liquids; and an ejection detector to detect whether the liquids are ejected from the nozzle of the liquid ejection head, the ejection detector including an insulated receiver having an adhering face to receive and adhere the liquids ejected from the nozzle and an electrode disposed on an opposite side of the adhering face of the receiver. The ejection detector detects electrical change generated when the liquids adhere to the adhering face of the receiver while generating a potential difference between the liquid ejection head and the electrode.

9 Claims, 7 Drawing Sheets

APPARATUS FOR EJECTING LIQUIDS, EJECTION DETECTION APPARATUS, AND EJECTION DETECTOR

BACKGROUND OF THE INVENTION

1. Field of the Invention

The disclosures herein generally relate to an apparatus for ejecting liquids, an ejection detection apparatus, and an ejection detector.

2. Description of the Related Art

An apparatus for ejecting liquids including an ejection detection apparatus which detects ejection status of a liquid ejection head (liquid droplet ejection head) is known in the related art.

Japanese Unexamined Patent Application Publication No. 2014-097642 discloses an ejection detection apparatus which ejects liquid droplets onto an electrode board from a head in order to detect ejection Or non-ejection by measuring electrical change when the liquid droplets land on the electrode board.

In the above described ejection detection apparatus, when detecting the ejection status by landing the liquid droplets onto the electrode board, a short circuit may occur via columnar liquids (liquid column) between the electrode board and the head due to fluctuation of a gap between the electrode board and the head, and a length of the liquids (droplets) ejected from a nozzle.

When the short circuit of the head and the electrode board occurs, a high voltage supplied to the electrode board is applied to the head. As a result, ejection abnormality occurs and reliability of the ejection detection decreases.

SUMMARY OF THE INVENTION

It is a general object of at least one embodiment of the present invention to provide an apparatus for ejecting liquids, an ejection detection apparatus, and an ejection detector that substantially obviate one or more problems caused by the limitations and disadvantages of the related art.

An embodiment of the present invention provides an apparatus for ejecting liquids including a liquid ejection head including a nozzle, the nozzle ejecting the liquids; and an ejection detector to detect whether the liquids are ejected from the nozzle of the liquid ejection head, the ejection detector including an insulated receiver having an adhering face to receive and adhere the liquids ejected from the nozzle and an electrode disposed on an opposite side of the adhering face of the receiver. The ejection detector detects electrical change generated when the liquids adhere to the adhering face of the receiver while generating a potential difference between the liquid ejection head and the electrode.

An embodiment of the present invention also provides an ejection detection apparatus for detecting whether liquids are ejected from a nozzle of a liquid ejection head including an insulated receiver having an adhering face to receive and adhere the liquids ejected from the nozzle; and an electrode disposed on an opposite side of the adhering face of the receiver. The ejection detector detects electrical change generated when the liquids adhere to the adhering face of the receiver while generating a potential difference generated between the liquid ejection head and the electrode.

An embodiment of the present invention also provides an ejection detector for detecting whether liquids are ejected from a nozzle of a liquid ejection head including an insulated receiver having an adhering face to receive and adhere the liquids ejected from the nozzle; and an electrode disposed on an opposite side of the adhering face of the receiver. The ejection detector detects electrical change generated when the liquids adhere to the adhering face of the receiver while generating a potential difference generated between the liquid ejection head and the electrode.

DESCRIPTION OF THE PREFERRED EMBODIMENTS

In the following, embodiments of the present invention will be described with reference to the accompanying drawings.

Figure 1:
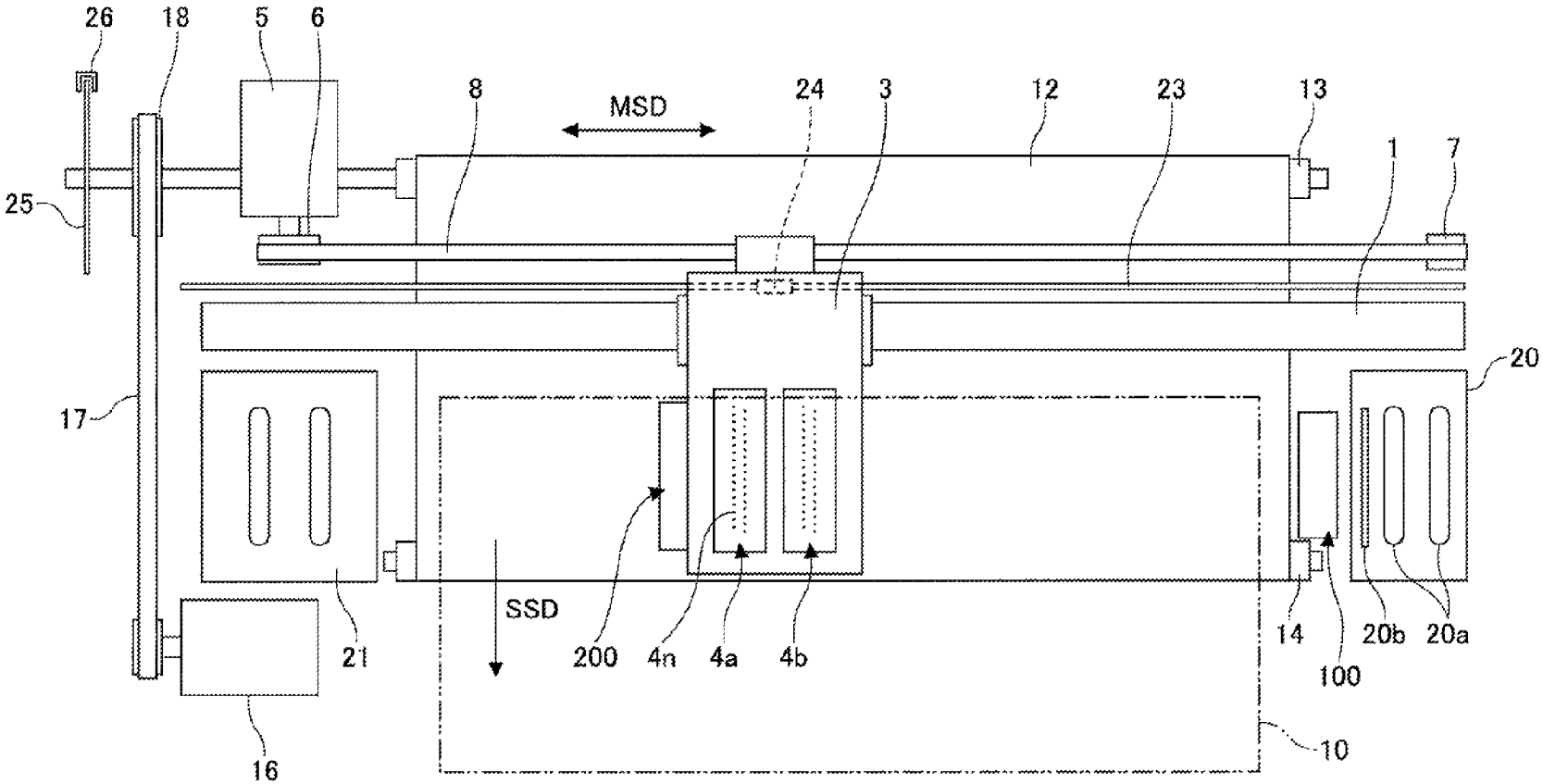
FIG. 1 is a plan view of a mechanical section of an apparatus for ejecting liquids according to a first embodiment.

First, an example of an apparatus for ejecting liquids according to a first embodiment will be described below with reference to FIG. 1. FIG. 1 is a plan view of a mechanical section of the apparatus for ejecting liquids.

In FIG. 1, the apparatus is a serial-type apparatus. In the apparatus, a carriage 3 is supported by a main guide member 1 and a sub guide member (not shown) so as to be movable. The main guide member 1 and the sub guide member extend between left and right side plates (not shown). A main scanning motor 5 reciprocally moves the carriage 3 in a main scanning direction (a moving direction of the carriage 3) MSD via a timing belt 8 held by a driving pulley 6 and a driven pulley 7.

Liquid ejection heads 4*a* and 4*b* (referred to as "the head 4" or "the heads 4" unless distinguished) are mounted on the carriage 3. The heads 4 eject, for example, liquids (ink) of respective colors, such as yellow (Y), cyan (C), magenta (M), and black (K). Further, nozzle rows Na and Nb are arranged on each of the heads 4. Each of the nozzle rows Na and Nb includes a plurality of nozzles 4*n*, in a sub scanning direction SSD perpendicular to the main scanning direction MSD. The liquids are ejected downward from the nozzles.

Figure 2:
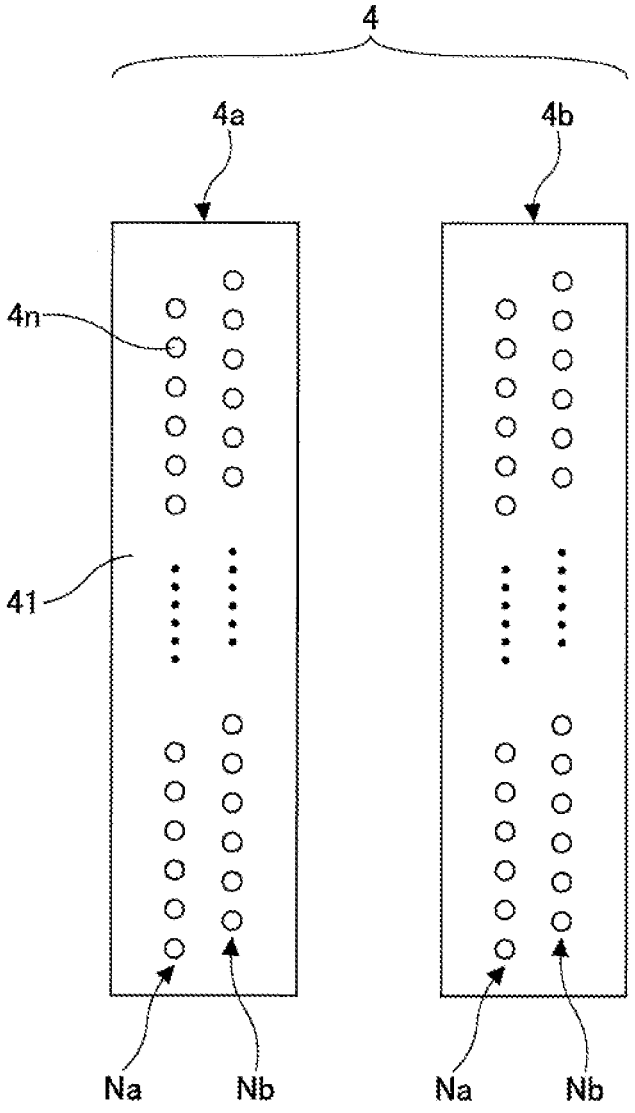
FIG. 2 is a schematic view of heads of the apparatus according to the first embodiment.

FIG. 2 is a schematic view of the heads 4 of the apparatus for ejecting the liquids according to the first embodiment. As illustrated in FIG. 2, each of the heads 4 includes two nozzle rows Na and Nb. Each of nozzle rows Na and Nb includes the nozzles 4*n*. The nozzle row Na of the head 4*a* ejects liquid droplets of black (K), and the nozzle row Nb of the head 4*a* ejects liquid droplets of cyan (C). The nozzle row Na of the head 4*b* ejects liquid droplets of magenta (M), and the nozzle row Nb of the head 4*b* ejects liquid droplets of yellow (Y).

The apparatus includes a conveyance belt 12, which is a conveyance unit, for conveying and holding a sheet 10, which is a medium, at a position opposite to the heads 4. The conveyance belt 12 is an endless belt and held by a conveyance roller 13 and a tension roller 14.

The conveyance roller 13 is rotated by a sub-scanning motor 16 via a timing belt 17 and a timing pulley 18 in order to circulate the conveyance belt 12 in the sub-scanning direction SSD. The conveyance belt 12 holds the sheet 10 with electrostatic attraction or air suction.

At one end side in the main scanning direction MSD of the carriage 3, a maintenance recovery mechanism 20 is disposed near a lateral side of the conveyance belt 12. The maintenance recovery mechanism 20 performs maintenance and recovery of the heads 4. At the opposite end side in the main scanning direction MSD of the carriage 3, an idle ejection receiving portion 21 for performing idle ejection is disposed at the lateral side of the conveyance belt 12.

The maintenance recovery mechanism 20 includes, for example, cap members 20*a* which cap nozzle faces (faces on which the nozzles 4*n* are formed) of the heads 4, a wiper member 20*b* which wipes the nozzle faces, and an idle ejection receiving portion to which liquids are ejected for keeping and recovering ejection capability (discharging performance).

Further, between the conveyance belt 12 and the maintenance recovery mechanism 20, an ejection detector 100 according to the first embodiment, which constitutes an ejection detection apparatus, is disposed in an area in which the ejection detector 100 can oppose (face) the heads 4. The ejection detection apparatus according to the first embodiment detects whether the liquids are ejected from the nozzle (s) 4*n* of the head(s) 4. On the other hand, the carriage 3 includes a wiping unit 200 which cleans a face to which the liquids adhere of the ejection detector 100.

Further, an encoder scale 23 having a predetermined pattern extends between the side plates along the main scanning direction MSD of the carriage 3. A main scanning encoder sensor 24 is disposed on the carriage 3. The encoder sensor 24 includes a transmissive photosensor which reads the pattern of the encoder scale 23. The encoder scale 23 and the main scanning encoder sensor 24 constitute a linear encoder (main scanning encoder) which detects movement of the carriage 3.

A code wheel 25 is mounted on a shaft of the conveyance roller 13. A sub scanning encoder sensor 26 includes a transmissive photosensor which detects a pattern formed in the code wheel 25. The code wheel 25 and the sub scanning encoder sensor 26 constitute a rotary encoder (sub scanning encoder) which detects the movement amount and movement position of the conveyance belt 12.

In the above described apparatus, the sheet 10 is fed from a sheet feed tray (not shown) by holding the sheet 10 on the conveyance belt 12, and conveyed in the sub-scanning direction SSD according to the circulation of the conveyance belt 12.

By driving the heads 4 in response to ejection signals while moving the carriage 3 in the main scanning direction MSD, the liquids are ejected onto the stopped sheet 10 in order to form one line of an image. Then, after the sheet 10 is fed by a certain distance, an operation for recording next line of the image is performed.

Receiving a signal which indicates that the recording has been completed or a rear end of the sheet 10 has arrived at the recording region, the apparatus finishes the recording operation and discharges the sheet 10 to a sheet discharge tray (not shown).

Figure 3:
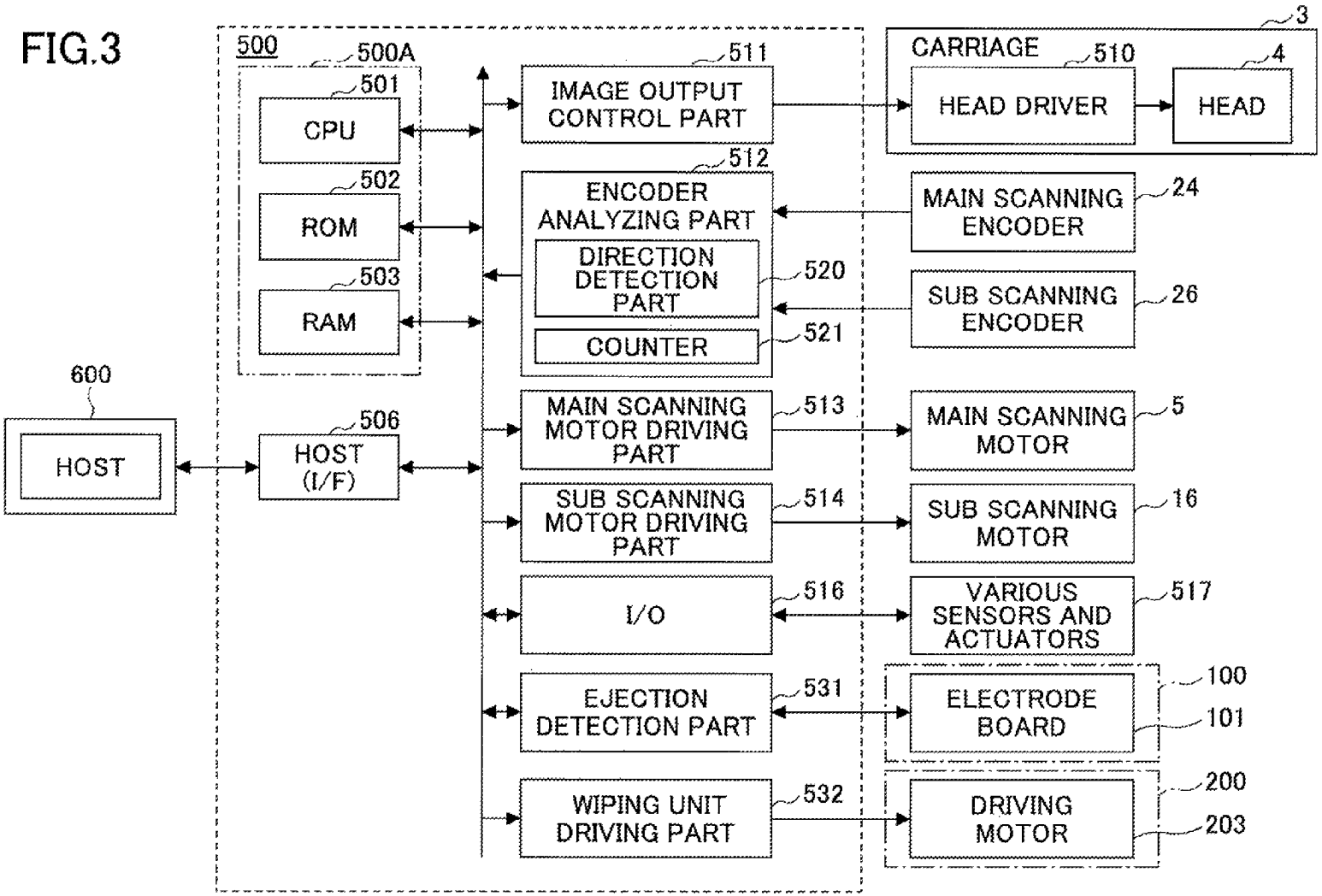
FIG. 3 is a block diagram of a control unit of the apparatus according to the first embodiment.

Next, an outline of a control unit 500 of the apparatus will be described with reference to FIG. 3. FIG. 3 is a block diagram of the control unit 500 of the apparatus.

The control unit 500 includes a main control unit 500A. The main control unit 500A includes a central processing unit (CPU) 501, a read-only memory (ROM) 502, and a random access memory (RAM) 503. The CPU 501 performs the overall control of the apparatus. The ROM 502 stores programs executed by the CPU 501 and other fixed data. The RAM 503 temporarily stores image data and other data.

Further, the control unit 500 includes a host interface (I/F) 506 which transmits and receives data to and from a host 600 (information processing apparatus), such as a personal computer (PC). The control unit 500 includes an image output control part 511 which controls driving of the heads 4, and an encoder analyzing part 512. The encoder analyzing part 512 inputs and analyzes detection signals from the main-scanning encoder sensor 24 and the sub-scanning encoder sensor 26.

Further, the control unit 500 includes a main-scanning motor driving part 513 which drives the main scanning motor 5, a sub scanning motor driver 514 which drives the sub-scanning motor 16, and an input/output (I/O) unit 516 connected to various sensors and actuators 517.

Further, the control unit 500 includes an ejection detection part 531 which measures (detects) electrical change when the liquid droplets land on an electrode board 101 of the ejection detector 100 in order to determine ejection or non-ejection. Further, the control unit 500 includes a wiping unit driving part 532 which drives a driving motor 203 of the wiping unit 200 which wipes the electrode board 101 of the ejection detector 100.

The image output control part 511 includes a data generation unit which generates print data, a driving waveform generation unit which generates driving waveforms for controlling driving of the heads 4, and a data transmission unit which transmits the print data and head control signals for selecting desired driving signals from the driving waveforms. The image output control part 511 outputs the driving waveforms, the head control signals, the print data and the like to a head driver 510, which is a head driving circuit for driving the heads 4 mounted on the carriage 3, in order to eject the liquids from the nozzles 4*n* of the heads 4 based on the print data.

Further, the encoder analyzing part 512 includes a direction detection part 520 which detects the movement direction of the carriage 3 from detection signals and a counter 521 which detects the movement amount of the carriage 3.

Based on the analysis result transmitted from the encoder analyzing part 512, the control unit 500 controls driving of the main scan motor 5 via the main scanning motor driving part 513 in order to control the movement of the carriage 3. Further, the control unit 500 controls driving of the sub scanning motor 16 via sub scanning motor driving part 514 in order to control feeding of the sheet 10.

When performing the ejection detection of the heads 4, the main control unit 500A of the control unit 500 moves the heads 4 to a position opposite to the ejection detector 100 and causes desired nozzles of the heads 4 to eject in order to determine ejection status based on detection signals from the ejection detection part 531.

Figure 4:
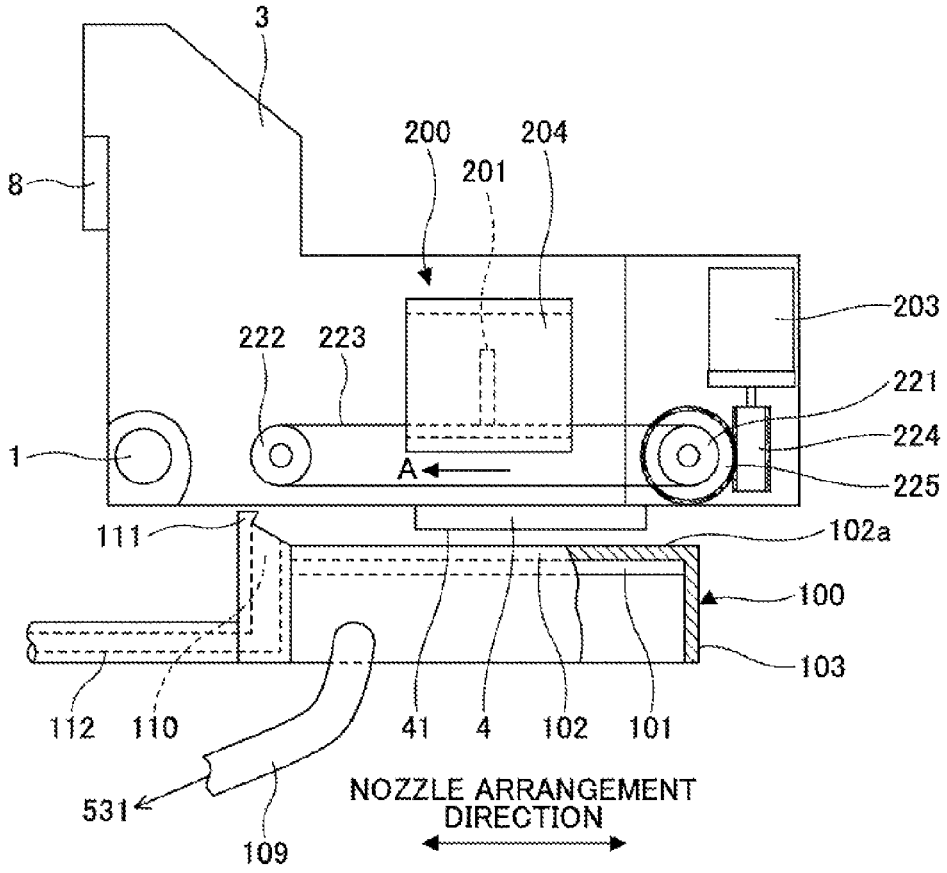
FIG. 4 is a lateral view of a carriage and an ejection detector according to the first embodiment in a state in which the ejection detector opposes the heads.
Figure 5:
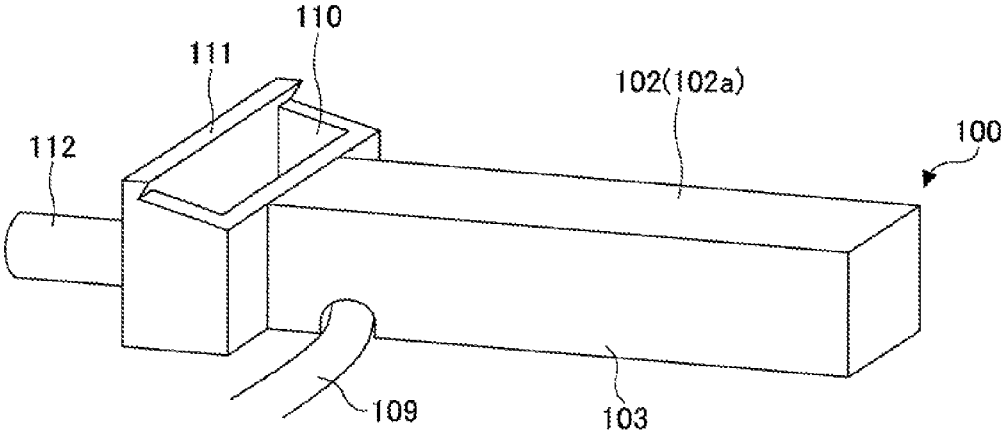
FIG. 5 a partial perspective view of the ejection detector according to the first embodiment.
Figure 6:
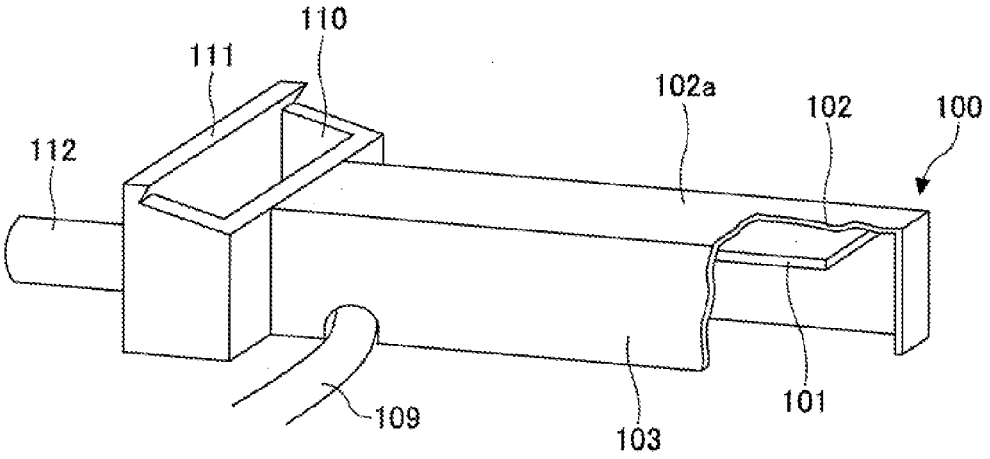
FIG. 6 is a partial perspective view of the ejection detector in which the ejection detector is partly cut out according to the first embodiment.

Next, the ejection detector 100 according to the first embodiment will be described with reference to FIG. 4 to FIG. 6. FIG. 4 is a lateral view of the carriage 3 and the ejection detector 100 in a state in which the ejection detector 100 opposes (face) the heads 4. FIG. 5 is a partial perspective view of the ejection detector 100. FIG. 6 is a partial perspective view of the ejection detector 100 in which the ejection detector 100 is partly cut out.

The ejection detector 100 includes a holder 103 which has a box shape. A receiver 102 which receives the liquids ejected from the heads 4 is integrally formed on the holder 103. A wall part of the upper face of the holder 103 is the receiver 102, and the upper face of the holder 103 to which the liquids ejected from the heads 4 adhere is a receiving face 102*a*.

In the holder 103, an electrode board 101, which is an electrode, is disposed on an opposite side (back face) of the receiving face (adhering face) 102*a* to which the liquids adhere. In this way, the electrode board 101 is covered with the receiver 102. In the first embodiment, the electrode board 101 is arranged in a state in which the electrode board 101 contacts the back face of the receiver 102.

The holder 103, which includes a part serving as the receiver 102, is an insulated member which is made of an insulated material, such as plastic. It is preferable to apply water repellent treatment to the receiving face 102*a* of the receiver 102.

The electrode board 101 is, for example, a conductive metal plate made of a material such as SUS304 and copper alloy plated with nickel (Ni) or palladium (Pd).

The electrode board 101 is electrically connected to the ejection detection part 531 via a lead cable 109.

Further, an opening portion 110 is formed on the holder 103 at a terminal end side in a wiping direction of a wiping member 201. A portion (edge portion) of the holder 103 forming the opening portion 110 also forms a wiper cleaner 111 which is a cleaning member. The wiper cleaner 111 removes waste liquid adhering to the wiping member 201 and cleans the wiping member 201.

It should be noted that the holder 103 includes a waste liquid tube 112 which forms a channel connected to a waste liquid tank (not shown) from a lower side of the opening portion 110. Further, it is preferable to provide a suction pump on the channel, which is connected to the waste liquid tank, for forcibly discharging the waste liquid accumulated on a bottom portion of the opening portion 110 into the waste liquid tank.

On the other hand, the wiping unit 200 is disposed on the carriage 3. The wiping unit 200 includes the wiping member 201 which moves for wiping the liquids adhering to the receiving face 102*a* of the receiver 102 along a nozzle arrangement direction.

The wiping member 201 is attached on a timing belt 223 wound around a driving pulley 221 and a driven pulley 222. When the driving pulley 221 is rotated by the driving motor 203 which is a driving source attached on the carriage 3 via a worm gear 224 and a gear 225, the wiping member 201 is circulated (moved) together with the timing belt 223 in a direction indicated by an arrow A shown in FIG. 4.

Further, the wiping unit 200 includes a wiper retraction cover 204 which covers the wiping member 201 at a retraction position. When the wiping member 201 is not being used, the wiping member 201 is accommodated in the wiper retraction cover 204. Such a configuration can prevent a slight amount of waste liquids adhering to the wiping member 201 from scattering during operation of the carriage 3.

In the apparatus for ejecting the liquids, the ejection detection apparatus may be constructed with, for example, a combination of the ejection detector 100 and the wiping unit 200, a combination of the ejection detector 100 and the ejection detection part 531, a combination of the ejection detector 100 and the main control unit 500A, or the like.

Figure 7:
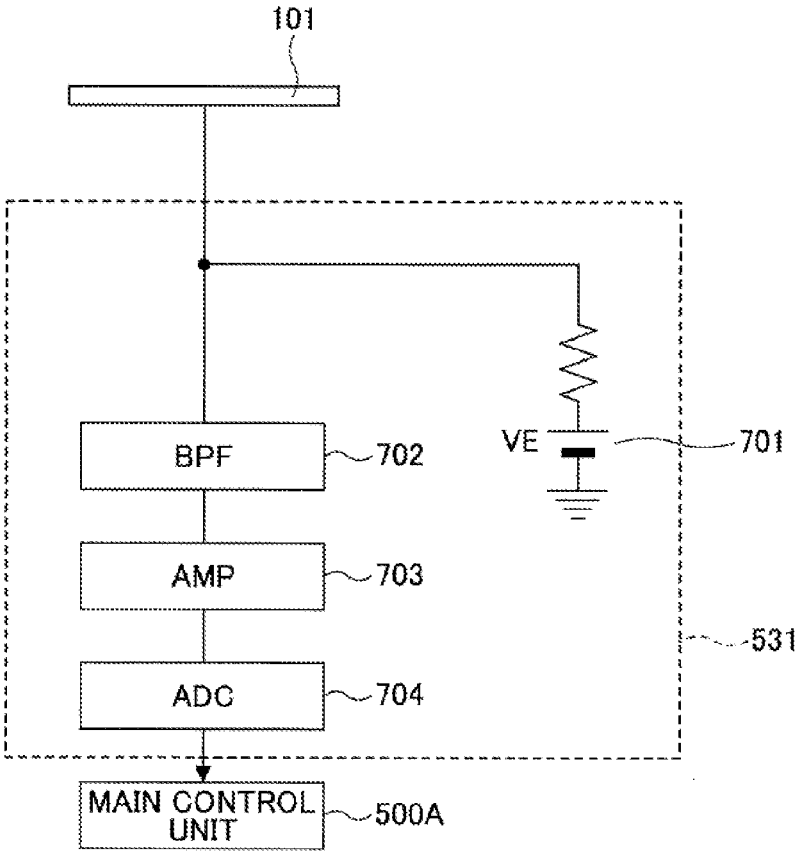
FIG. 7 is a block diagram of an ejection detection part according to the first embodiment.
Figure 8:
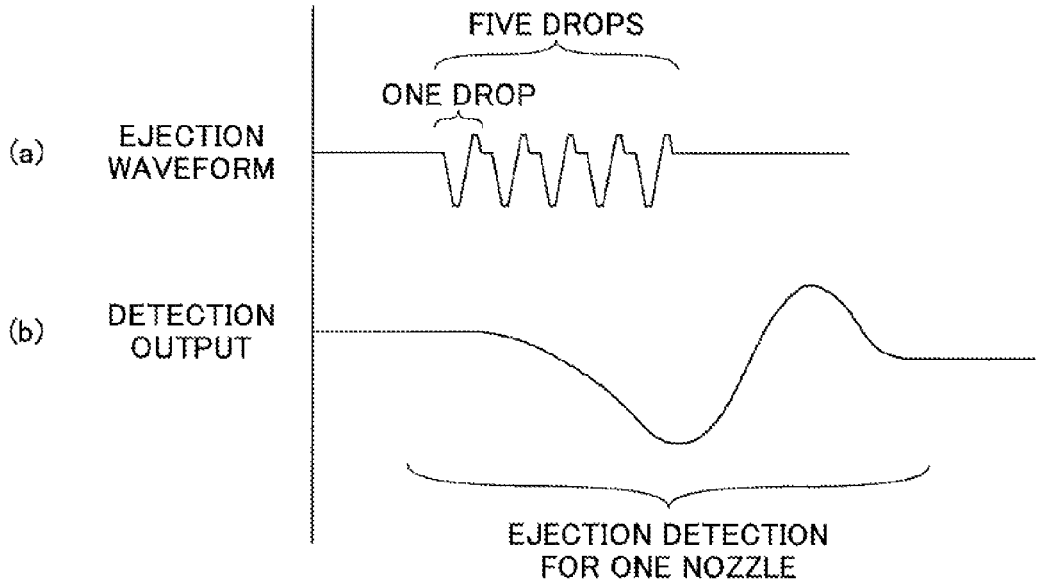
FIG. 8 is a graph which indicates detection output of the ejection detection part according to the first embodiment.

Next, an example of the ejection detection part 531 will be described with reference to FIG. 7 and FIG. 8. FIG. 7 is a block diagram of the ejection detection part 531. FIG. 8 is a graph which indicates detection output of the ejection detection part 531.

As illustrated in FIG. 7, the ejection detection part 531 includes a high-voltage power source 701 which supplies a high voltage VE (for example, 750 V) to the electrode board 101. The main control unit 500A controls on and off states of the high-voltage power source 701.

Further, the ejection detection part 531 includes a band pass filter (BPF) 702 which inputs signals responding to electrical changes that occur when the ejected liquids adhere to the receiving face 102*a* of the receiver 102, an amplification (AMP) circuit 703 which amplifies the signals, and an analog-digital converter (ADC) 704 which converts the amplified signals from analog format to digital format. The converting result of the ADC 704 is input to the main control unit 500A.

When the ejection detection is performed, the main control unit 500A causes the nozzle faces 41 of the heads 4 to oppose the electrode board 101, and the high voltage VE is supplied to the electrode board 101 in order to generate a potential difference (electrical potential difference) between the nozzle faces 41 and the electrode board 101. At this time, the nozzle faces 41 of the heads 4 are charged negatively, and the electrode board 101 is charged positively.

In such a state, the liquids for detection are ejected from each of the nozzles 4*n* of the heads 4.

At this time, because the liquid droplets are ejected from the nozzle face 41 of the head 4 which is charged negatively, the liquids are also charged negatively. When the liquid droplets negatively charged adhere to the receiving face 102*a* of the receiver 102, which is the insulated receiver, and the liquids approach the electrode board 101 charged positively, the voltage of the high voltage VE supplied to the electrode board 101 slightly fluctuates (changes).

The band-pass filter 702 extracts such voltage change (AC component), and the amplification circuit 703 amplifies the signal corresponding to the voltage change. The ADC 704 converts the amplified component from analog format to digital format and inputs the converted data as a measurement result (detection result) to the main control unit 500A.

For example, when giving waveforms (ejection waveforms) in which five droplets of liquid are ejected successively as shown in FIG. 8(*a*), detection output (AC component) is obtained as shown in FIG. 8(*b*) if the nozzle ejects normally.

The main control unit 500A determines whether the measurement result (corresponding to the fluctuation) is greater than a preset threshold, and when the measurement result is greater than the preset threshold, the main control unit 500A determines that a detected nozzle of the head 4 has ejected a liquid droplet(s). On the other hand, when the measurement result is not greater than the threshold value, the main control unit 500A determines that the detected nozzle of the head 4 has not ejected the liquid droplet(s).

When ejecting from the nozzles 4*n* of the heads 4 one by one, it takes approximately 0.5 to 10 msec to determine ejection or non-ejection of a single nozzle. Thus, the first embodiment can give, to two nozzles, waveforms for ejecting at the same time, and compare the detection outputs with two preset thresholds in order to determine whether both of the two nozzles eject, one of the two nozzles ejects, or neither of the two nozzles eject.

After ejection or non-ejection for all of the nozzles is determined, the voltage VE supplied to the electrode board 101 is turned into off state. As described above, the ejection detector 100 can detect whether the liquids are ejected by detecting the electrical change generated when the liquids adhere to the receiving face 102*a* of the receiver 102 while generating the potential difference generated between the heads 4 and the electrode board 101.

Figure 9:
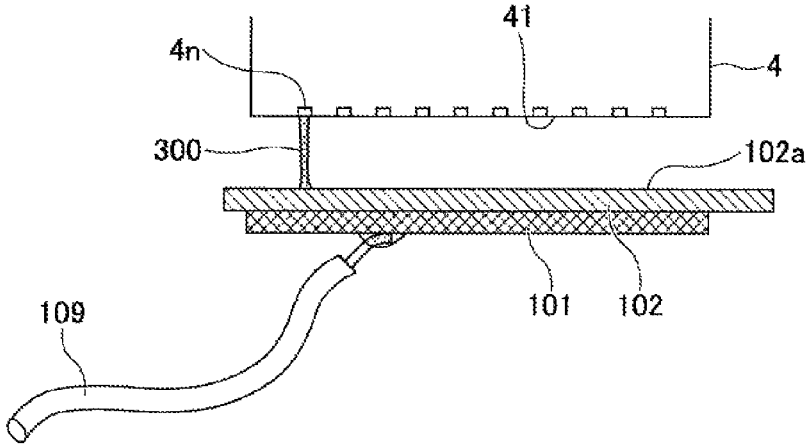
FIG. 9 is a drawing illustrating an example of the first embodiment for describing an effect of the first embodiment.
Figure 10:
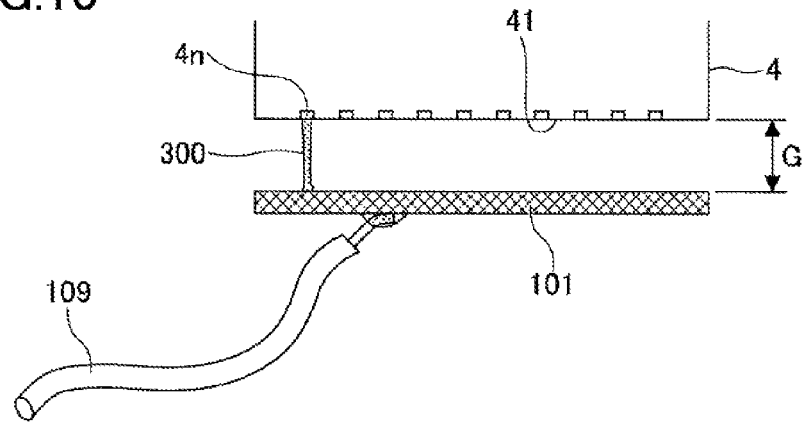
FIG. 10 is a drawing of a comparative example for describing a problem of the comparative example.

Next, an effect of the ejection detector 100 according to the first embodiment described above will be described with reference to FIG. 9 and FIG. 10. FIG. 9 is a drawing illustrating an example of the first embodiment for describing an effect of the first embodiment. FIG. 10 is a drawing of a comparative example for describing a problem of the comparative example.

As shown in FIG. 10, the comparative example does not include the receiver 102 of the first embodiment. In the comparative example, the nozzle faces 41 of the heads 4 and the electrode board 101 are directly opposing to each other and the liquids are landed on the face of the electrode board 101.

Thus, in the comparative example, a short circuit between the electrode board 101 and the heads may occur via a liquid column 300 due to fluctuation of a gap G between the heads 4 and the electrode board 101 and fluctuation of a length of the liquids ejected from the nozzles 4*n*.

At this time, as described above, the high potential difference (for example, 600 V to 800 V) is supplied between the heads 4 and the electrode board 101. Thus, there is a possibility that the liquids in the heads 4 are electrolyzed and bubbles are generated in a channel in the heads 4 when the short circuit occurs between the heads 4 and the electrode board 101. As the result, ejection abnormality such as curving of ejecting and an ejection error may occur.

On the other hand, in the first embodiment, the receiver 102, which is the insulated receiver, receives the liquids ejected from the heads 4, and the electrode board 101 is disposed on the opposite side of the receiver 102 with respect to the heads 4.

Thus, in the first embodiment as shown in FIG. 9, the short circuit of the electrode board 101 and the heads 4 does not occur even when the liquid column 300 connects the heads 4 and the receiver 102 due to the fluctuation of the gap between the heads 4 and the electrode board 101 and the length of the liquids ejected from the nozzles 4*n*.

In this way, the ejection detecRFtion unit 100 according to the first embodiment can reduce the ejection abnormality due to the short circuit and perform the ejection detection with high reliability.

Further, because the short circuit of the electrode board 101 and the heads 4 does not occur even if the liquid column 300 connects the heads 4 and the receiver 102, the apparatus according to the first embodiment can eject the liquids which have a length connecting the heads 4 and the receiver 102, like the liquid column 300, when performing the ejection detection.

The electrical change generated in the electrode board 101 is increased by ejecting the liquids which have the length connecting the heads 4 and the receiver 102. Thus, in the first embodiment, capability of the ejection detection can be improved.

Further, in a configuration where the nozzles 4*n* ejects the liquids directly to the electrode board 101 like the comparative example, there is a case in which insulation of the electrode board 101 and a housing of the apparatus whose electrical potential is 0 V (GND) cannot be maintained when a large amount of liquids adheres to the outer face of the holder 103 due to mist in the apparatus or abnormal dripping from the heads 4, resulting in superposing of noise on the detection output and detecting inaccurately.

On the other hand, in the first embodiment, the receiver 102 is formed as a part of the holder 103 which has the box shape, and the electrode board 101 is disposed in the holder 103 such that the holder 103 covers the electrode board 101.

Thus, even if a large amount of the liquids adhere to the outer face of the holder 103, the ejection detector according 100 to the first embodiment can maintain the insulation between the electrode board 101 and the housing of the apparatus, whose electrical potential is 0 V (GND), while some liquids drip downward in the gravity direction. Thus, the noise is not generated in the first embodiment.

Figure 11:
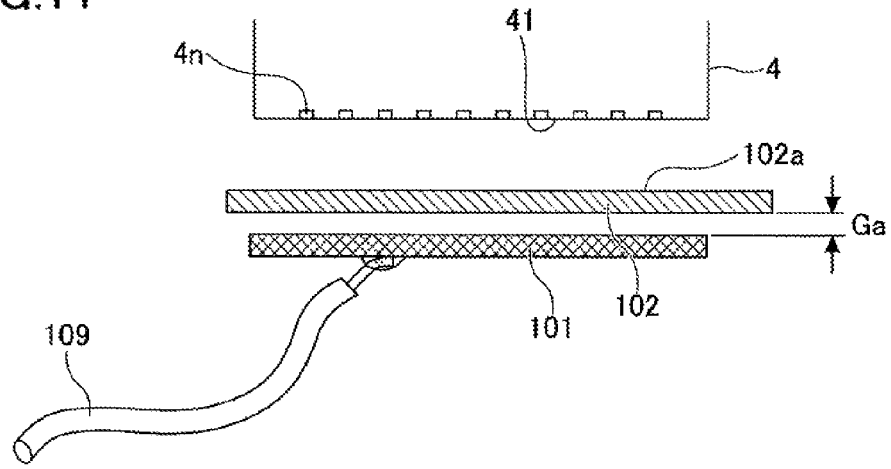
FIG. 11 is a conceptual drawing of the ejection detector according to a second embodiment.

Next, a second embodiment will be described with reference to FIG. 11. FIG. 11 is a conceptual drawing of the ejection detector 100 according to the second embodiment.

In the second embodiment, the receiver 102, which is the insulated receiver, is disposed apart from the electrode board 101 by a gap Ga. It should be noted that other configurations of the second embodiment may be similar to the configurations of the first embodiment.

In the second embodiment, the detection status can be detected because the electrical potential of the electrode board 101 changes according to the liquids charged in a reverse polarity approaching the electrode board 101 charged via the receiver 102.

Figure 12:
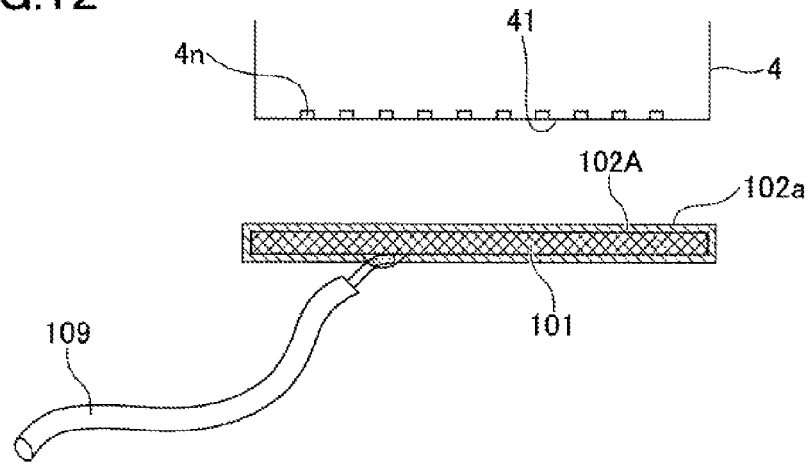
FIG. 12 is a conceptual drawing of the ejection detector according to a third embodiment.

Next, a third embodiment will be described with reference to FIG. 12. FIG. 12 is a conceptual drawing of the ejection detector 100 according to the third embodiment.

In the third embodiment, an insulated film 102A is formed on the surface of the electrode board 101. The insulated film 102A serves as the receiver. It should be noted that other configurations of the third embodiment may be similar to the configurations of the first embodiment. Although the insulated film 102A is formed on the entire face of the electrode board 101 in the third embodiment, the present invention is not limited to this. For example, the insulated film 102A may be formed on at least a face side of the electrode board 101 opposite to the heads 4.

In the third embodiment, effects similar to the effects of the first embodiment can be obtained, because the insulated film 102A intervenes between the electrode board 101 and the heads 4, and the short circuit of the electrode board 101 and the heads 4 due to the liquid column 300 does not occur.

In this disclosure, "the apparatus for ejecting liquids" indicates an apparatus which includes a liquid ejection head or a liquid ejection unit and drives the liquid ejection head or the liquid ejection unit in order to eject the liquids. An apparatus which is able to eject the liquids to a medium (object to which the liquids adhere) to which the liquids can adhere may be used as the apparatus for ejecting the liquids.

"The apparatus for ejecting the liquids" may include the liquid ejection head or the liquid ejection unit, a control unit configured to control operation of the liquid ejection, a unit configured to feed, to convey, and to discharge the object to which the liquids adhere and another apparatus such as a preprocessing apparatus and a post processing apparatus.

Further, a recording apparatus, a printing apparatus, an image forming apparatus, a liquid droplets ejection apparatus, a liquids ejection apparatus, a process liquids coating apparatus, a solid shaping apparatus, an apparatus which generates minute particles by a spray granulation method, a printer, a multifunction peripheral (MFP), a three-dimensional (3D) printer and the like may be used as "the apparatus for ejecting the liquids".

Further, "the apparatus for ejecting the liquids" is not limited to an apparatus which generates (visualize) meaningful images such as characters and figures by ejecting the liquids. For example, an apparatus which generates meaningless images such as patterns or three dimensional images may be used as the apparatus for ejecting the liquids.

The above described "medium to which the liquids can adhere" indicates a medium to which the liquids can adhere even temporarily. The "medium to which the liquids can adhere" may be made of a material, to which the liquids can adhere even temporarily, such as paper, string, fiber, cloth, leather, metal, plastic, glass, timber, and ceramic.

Further, ink, process liquid, DNA samples, resist, pattern material, a binding agent, shaping liquid and the like may be used for the "liquids".

Further, a serial-type apparatus which moves the liquid ejection heads or a line-type apparatus which does not move the liquid ejection heads may be used as "the apparatus for ejecting the liquids" unless limited specifically.

"The liquid ejection unit" includes the liquid ejection head(s), another functional part, and another mechanism integrally and indicates an aggregation of parts which correspond to the ejection of the liquids. For example, "the liquid ejection unit" may include a configuration in which at least one of a head tank, a carriage, a supplying mechanism, a maintenance mechanism, and a main scanning movement mechanism is arbitrarily combined with the liquid ejection head.

The main scanning movement mechanism is a mechanism for moving the liquid ejection head(s) in the main scanning direction. For example, the main scanning movement mechanism may be constructed by combining a guide member which guides the liquid ejection head or the carriage, the driving source, and a movement mechanism of the carriage. The guide member single body may be included in the main scanning movement mechanism.

The supplying mechanism is a mechanism for supplying the liquids stored outside of the liquid ejection head to the liquid ejection head. For example, the supplying mechanism may include a mounting portion for mounting a liquid cartridge and a tube. Further, the tube single body or the mounting portion single body may be included in the supplying mechanism.

The maintenance mechanism is a mechanism for performing maintenance and recovery of capability of the liquid ejection head(s). For example, the maintenance mechanism may have a configuration in which at least two of a cap, a wiping member, a suction unit connected to the cap such as a suction pump, and an idle receiving portion are combined.

For example, the mechanism in which the liquid ejection head and the other functional part/mechanism are integrated may have a fasten member, glue or heat caulking for fixing, a tube for connecting, or members engaging each other (including members in which one member slidably engages with the other member). Further, the present invention is not limited to the configuration in which the liquid ejection head and the other functional part/mechanism are fixed, connected, or engaged, directly. The present invention may use a configuration in which the liquid ejection head and the other functional part/mechanism are fixed, connected, engaged via an intermediate member.

For example, a configuration in which the liquid ejection head and the head tank are fixed with the fasten member, the glue or the like in order to integrate the liquid ejection head and the head tank may be used for the liquid ejection unit. Further, a configuration in which the liquid ejection head and the head tank are connected to each other by the tube or the like in order to integrate the liquid ejection head and the head tank may be used for the liquid ejection unit. Further, the liquid ejection unit may include a unit including a filter between the head tank and the liquid ejection head.

Further, a configuration in which the liquid ejection head and the carriage are fixed with the fasten member, the glue or the like in order to integrate the liquid ejection head and the carriage may be used for the liquid ejection unit. Further, a configuration in which the liquid ejection head and the carriage are fixed via an attachment member for attaching in order to integrate the liquid ejection head and the carriage may be used for the liquid ejection unit.

Further, a configuration in which the liquid ejection head slidably engages (or, attaches) with a guide member forming a part of the main scanning movement mechanism in order to integrate the liquid ejection head and the main scanning movement mechanism may be used for the liquid ejection unit. Further, a configuration in which the carriage, on which the liquid ejection head is attached, slidably engages (or, attaches) with the guide member forming the part of the main scanning movement mechanism in order to integrate the liquid ejection head and the main scanning movement mechanism may be used for the liquid ejection unit.

Further, a configuration in which the liquid ejection head and a cap which is a part of the maintenance mechanism are fixed with the fasten member or the like in order to integrate the liquid ejection head and the maintenance mechanism may be used for the liquid ejection unit. Further, a configuration in which the carriage, on which the liquid ejection head is attached, and the cap, which is the part of the maintenance mechanism, are fixed with the fasten member or the like in order to integrate the liquid ejection head and the maintenance mechanism may be used for the liquid ejection unit.

Further, a configuration in which a tube for supplying the liquids from the outside to the inside of the liquid ejection head is connected to the liquid ejection head in order to integrate the liquid ejection head and the supplying mechanism may be used for the liquid ejection unit. Further, a configuration in which a channel part to which the tube is connected is attached to the liquid ejection head in order to integrate the liquid ejection head and the supplying mechanism via the channel part may be used for the liquid ejection unit. Further, a configuration in which the head tank to which the tube is connected is attached to the liquid ejection head in order to integrate the liquid ejection head and head tank may be used for the liquid ejection unit.

Moreover, a configuration in which the liquid ejection head, the carriage, the main scanning mechanism, the maintenance mechanism and the supplying mechanism are integrated may be used as "the liquid ejection unit".

Further, a pressure generation unit used for "the liquid ejection head" is not limited. For example, other than a piezoelectric actuator (laminated piezoelectric element may be used) described in above embodiments, a thermal actuator using an electricity-heat conversion element such as a heat resistance element, or an electrostatic actuator including a vibration plate and a counter electrode may be used.

Further, in this disclosure, the terms image formation, recording, printing, image recording, image printing, shaping and the like are used herein as synonyms for one another.

Further, the present invention is not limited to these embodiments, but various variations and modifications may be made without departing from the scope of the present invention.

The present application is based on and claims the benefit of priority of Japanese priority application No. 2015-039894 filed on Mar. 2, 2015 with the Japanese Patent Office, the entire contents of which are hereby incorporated by reference.

What is claimed is:

1. An apparatus for ejecting liquids comprising:

a liquid ejection head including a nozzle, the nozzle ejecting the liquids; and an ejection detector to detect whether the liquids are ejected from the nozzle of the liquid ejection head, the ejection detector including (a) an insulated receiver having a first face and a second face opposite to the first face, the first face being disposed to receive and adhere the liquids ejected from the nozzle and (b) an electrode disposed on the second face of the insulated receiver, the electrode being insulated by the insulated receiver from the liquids received and adhered at the first face of the receiver, wherein the ejection detector detects electrical change generated when the liquids adhere to the first face of the receiver while generating a potential difference between the liquid ejection head and the electrode.

2. The apparatus for ejecting liquids according to claim 1, wherein the receiver and the electrode contact with each other.

3. The apparatus for ejecting liquids according to claim 1, wherein the receiver and the electrode are arranged apart from each other.

4. The apparatus for ejecting liquids according to claim 1, wherein the receiver covers the electrode.

5. The apparatus for ejecting liquids according to claim 1, wherein the nozzle is configured to eject the liquids which have a length reaching to the receiver from the nozzle when the ejection detector detects whether the liquids are ejected.

6. The apparatus for ejecting liquids according to claim 1, wherein the receiver is an insulated film formed on a surface of the electrode.

7. The apparatus for ejecting liquids according to claim 1, wherein the insulated receiver insulates the electrode from the liquids ejected onto the first face of the insulated receiver, and the liquids ejected onto the first face of the insulated receiver do not pass through the insulated receiver to the electrode.

8. An ejection detection apparatus for detecting whether liquids are ejected from a nozzle of a liquid ejection head comprising:

an insulated receiver having a first face and a second face opposite to the first face, the first face being disposed to receive and adhere the liquids ejected from the nozzle; and an electrode disposed on the second face of the insulated receiver, the electrode being insulated by the insulated receiver from the liquids received and adhered at the first face of the receiver, wherein the ejection detection apparatus detects electrical change generated when the liquids adhere to the first face of the receiver while generating a potential difference generated between the liquid ejection head and the electrode.

9. An ejection detector for detecting whether liquids are ejected from a nozzle of a liquid ejection head comprising:

an insulated receiver having a first face and a second face opposite to the first face, the first face being disposed to receive and adhere the liquids ejected from the nozzle; and an electrode disposed on the second face of the insulated receiver, the electrode being insulated by the insulated receiver from the liquids received and adhered at the first face of the receiver, wherein the ejection detector detects electrical change generated when the liquids adhere to the first face of the receiver while generating a potential difference generated between the liquid ejection head and the electrode.

* * * * *